US005992497A

United States Patent [19]

Jaehnen et al.

[11] Patent Number: 5,992,497

[45] Date of Patent: Nov. 30, 1999

[54] SLIP AND LOCK CONNECTION SYSTEM

[75] Inventors: Edwin C. Jaehnen, Cincinnati; Richard J. Lewis, Jr., Loveland; Kenneth E. Carper, Cincinnati; Bob Bailey, Trenton, all of Ohio

[73] Assignee: Clopay Building Products Company, Inc., Cincinnati, Ohio

[21] Appl. No.: 08/842,943

[22] Filed: Apr. 25, 1997

[51] Int. Cl.[6] ..... E05D 15/06

[52] U.S. Cl. ..... 160/201; 16/97; 16/225; 403/393

[58] Field of Search ..... 160/201, 191, 160/192, 193; 16/225, 97; 248/220.1, 222.4, 300; 403/393, 316, 384

[56] References Cited

U.S. PATENT DOCUMENTS

| | | | |
|---|---|---|---|
| 1,341,068 | 5/1920 | Okun . | |
| 3,548,425 | 12/1970 | Goldstein . | |
| 3,740,916 | 6/1973 | Kenaga | 160/201 X |
| 4,129,279 | 12/1978 | Burkholder | 211/192 X |
| 4,154,419 | 5/1979 | Breidenbach . | |
| 4,165,944 | 8/1979 | Sunasky | 211/192 X |
| 4,193,245 | 3/1980 | Johnson . | |
| 4,222,542 | 9/1980 | Wilson et al. . | |
| 4,958,399 | 9/1990 | Toal et al. . | |
| 5,004,198 | 4/1991 | Jager . | |
| 5,025,937 | 6/1991 | King . | |
| 5,054,536 | 10/1991 | Leist et al. . | |
| 5,148,850 | 9/1992 | Urbanocl | 160/201 X |
| 5,188,163 | 2/1993 | Schwartzengraber et al. . | |
| 5,351,740 | 10/1994 | Hanna . | |
| 5,353,473 | 10/1994 | Sherick . | |
| 5,375,383 | 12/1994 | Lin et al. . | |
| 5,404,927 | 4/1995 | Bailey . | |
| 5,408,724 | 4/1995 | Mullet et al. . | |
| 5,409,051 | 4/1995 | Mullet et al. . | |
| 5,568,672 | 10/1996 | Mullet et al. . | |
| 5,782,283 | 7/1998 | Kendall | 160/201 X |

*Primary Examiner*—Blair M. Johnson
*Attorney, Agent, or Firm*—Wood, Herron & Evans L.L.P.

[57] ABSTRACT

A connection system for interconnecting various components, such as components of an overhead garage door system, is provided which includes, in one aspect, a first component having a pair of spaced apart hook members, an intermediate guide member and a detent extending from a planar body of the first component. A second component includes a pair of spaced apart apertures which are shaped and aligned to receive the hook members, and an intermediate aperture which is shaped and aligned to receive the guide member upon registration of the first and second components in face-abutting relationship. As the first and second components are translated relative to each other, the detent of the first component engages the intermediate aperture of the second component to thereby establish a connection between the first and second components. Connection of a roller bracket to a door stile of an overhead garage door system is provided by the novel connection system, as well as connection of a door stile to a door panel. In a second aspect of the invention, interconnection of horizontal tracks, vertical tracks and track radiuses is provided by the novel connection system to form continuous door tracks on opposite sides of a door frame.

7 Claims, 7 Drawing Sheets

38
38
34
26
28
36
46
82b
46
70b
68
10
52
80
82a
86
30
70a
78
76
44
80
84
40
32
5
76
44
44
78
76
80
76
42
68
52
46
70b
74
46
72
5
58
22
48
64
54
50
56
48
64
34
38
36
134
136
174
152
170b
122
154
156
170b
154
150
156
162b

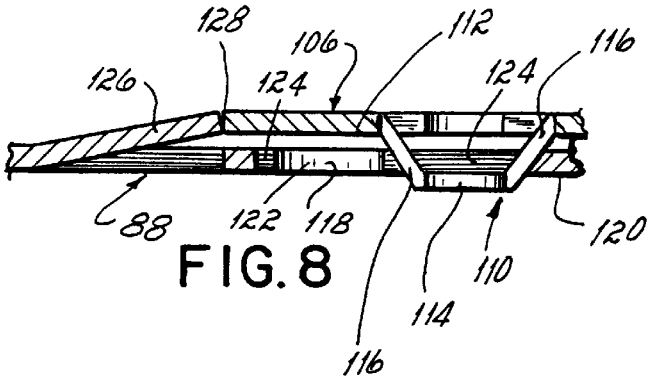
FIG. 8
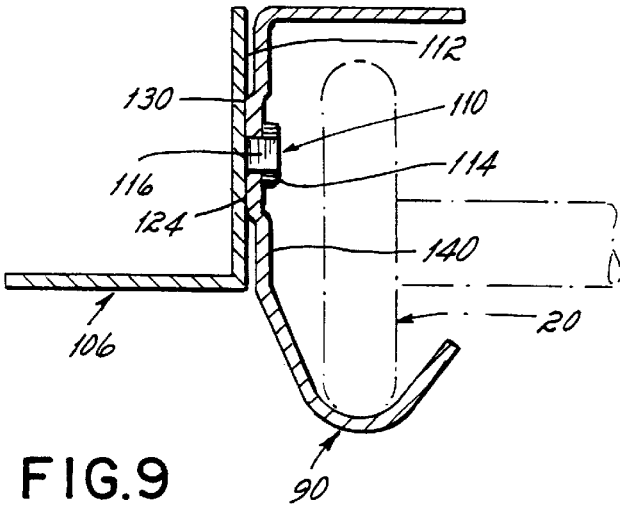
FIG. 9
FIG. 10A
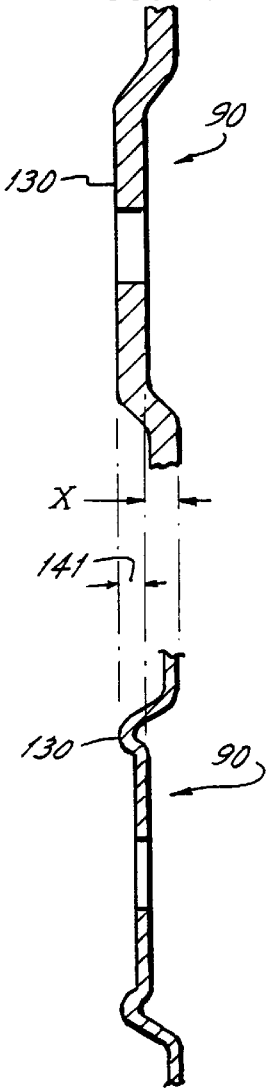
FIG. 10B

SLIP AND LOCK CONNECTION SYSTEM

FIELD OF THE INVENTION

The present invention relates generally to connection systems and, more particularly, but in no way limited to, a connection system for interconnecting components of an overhead garage door system.

BACKGROUND OF THE INVENTION

Overhead garage door systems are widely used in both residential and commercial applications, and are designed to be operated either manually or automatically through a reversible motor. Overhead garage doors typically include a series of interconnected door panels which are connected along their longitudinal edges by one or more hinges to provide pivotal movement of the door panels between vertical and horizontal positions as is known in the art. The door panels typically include a series of roller brackets mounted on opposite sides of the door panels for supporting a series of rollers. The rollers travel in a pair of continuous tracks mounted on opposite sides of a door frame which guide movement of the door panels between the vertical and horizontal positions.

Overhead garage door panels typically include two or more spaced door stiles mounted vertically on each door panel to support various hardware components of the garage door system and to add additional strength and rigidity to the panels. These hardware components may include, for example, hinges for providing pivotal movement at each joint between adjacent door panels, and roller brackets for supporting the rollers which travel within the opposite pair of door tracks. Typically, hinges and roller brackets are attached to the door stiles through fasteners, such as rivets, screws and bolts for example, to provide an interconnection of components which can withstand the load and vibrational forces to which the door panels are generally subjected.

Additionally, the door tracks in which the garage door travels are typically mounted through various bracket and fastener assemblies to a door frame. Each door track includes a horizontal track which extends generally parallel to the garage ceiling and has an integral radius section for guiding movement of the garage door between the horizontal and vertical positions. Each door track further includes a vertical track which is mounted generally parallel to the door frame and which forms a linear extension of the radius section which extends from the horizontal track. Depending on the size of the garage door opening and the available overhead room, different horizontal track radiuses are used to accommodate for different installation requirements. That is, one installation may require a ten inch radius on the horizontal track while another installation may require a twelve or fifteen inch radius. Thus, different configurations of horizontal track, i.e., with an integral ten, twelve or fifteen inch radius, for example, must be properly selected for a particular installation.

Due to the size and weight of the overhead garage door components, and the general complexity associated with their assembly, overhead garage door systems typically are shipped by the manufacturer to a dealer for assembly at a site by a professional installer. It will be appreciated that the amount of parts which needs to be boxed and shipped by the manufacturer, as well as the length of time required for assembly of the overhead garage door system at each site, is affected by the number of mechanical fasteners included in the overhead garage door system. Moreover, the dealer or installer must carry a greater inventory of parts as the number of unique track components and fasteners in the overhead garage door system is increased.

Accordingly, there is a need in the overhead garage door industry for a connection system which provides for rapid interconnection of garage door components in the field with a reduced number of mechanical fasteners required to accomplish the interconnection. There is also a need for a connection system which provides a reliable interconnection of garage door components while the components are subjected to loads and vibrations during use of the overhead garage door system. Additionally, there is a need for a connection system which is suitable for overhead garage door systems which is relatively easy to manufacture without requiring the formation of complicated mechanical fastening structures on the individual garage door components to provide the interconnection. Moreover, there is a need for an overhead garage door connection system which easily accommodates for changes in the configuration of the garage door system at the installation site.

SUMMARY OF THE INVENTION

To these ends, a connection system is provided which provides for rapid interconnection of components for numerous applications with a reduced number of mechanical fasteners. The connection system of the present invention is suitable for interconnection of components of an overhead garage door system, and provides a reliable interconnection of garage door components which may be subjected to loads and vibration during use of the overhead garage door system. The connection system of the present invention provides interconnection of two or more components without the need to manufacture complicated fastening structures on the various garage door components. Moreover, changes in the configuration of the garage door system at an installation site are readily accommodated for by the connection system of the present invention.

In one use of the present invention, the connection system of the present invention includes a first component having a pair of spaced apart hook members, an intermediate guide member and a detent extending from a planar body of the first component. The connection system further includes a second component having a pair of spaced apart apertures which are shaped and aligned to receive the hook members, and an intermediate aperture which is shaped and aligned to receive the guide member upon registration of the first and second components in face-abutting relationship. As the first and second components are translated relative to each other, the detent of the first component engages the intermediate aperture of the second component to thereby establish a connection between the first and second components.

Preferably, the hook members and guide member of the first component include retaining elements which are offset from and substantially parallel to the planar body of the first component. In this way, as the first and second components are translated relative to each other, the offset retaining elements of the hook members and guide member capture and engage a portion of the second component between the respective retaining elements and the planar body of the first component.

In one aspect of the present invention in the assembly of an overhead garage door system, a roller bracket is provided which includes the pair of spaced apart hook members, intermediate guide member and detent member. A door stile is further provided which includes the pair of spaced apart apertures shaped and aligned to receive the hook members, and the intermediate aperture shaped and aligned to receive the guide member upon registration of the roller bracket and door stile in face-abutting relationship. As the roller bracket and door stile are translated relative to each other, the detent of the roller bracket engages the intermediate aperture of the door stile to thereby establish a connection between the roller bracket and the door stile.

In yet another aspect of the present invention in the assembly of an overhead garage door system, the door stile includes a pair of guide members and an intermediate detent member extending from a planar web of the door stile. A door panel is provided which includes a pair of spaced apart apertures which are shaped and aligned to receive the guide members of the door stile upon registration of the door stile and door panel in face-abutting relationship. As the door stile is translated relative to the door panel, the detent of the door stile engages one of the spaced apart apertures in the door panel to thereby establish a connection between the door stile and the door panel.

In a second use of the present invention in the assembly of an overhead garage door system, a pair of door tracks are formed from respective pairs of horizontal tracks, vertical tracks and track radiuses which are assembled at the installation site. A pair of spaced horizontal rails are supported by a door frame and preferably include a series of guide members which extend from a vertical surface of each horizontal rail. The horizontal tracks and track radiuses each preferably include a series of apertures which are shaped and aligned to receive the guide members of the horizontal rails upon registration of the components in face-abutting relationship. As the components are translated relative to each other, the guide members of the horizontal rails engage the horizontal tracks and the track radiuses to establish a connection therebetween. The horizontal tracks, vertical tracks, and track radiuses guide movement of the overhead garage door between the horizontal and vertical positions.

The above features and advantages of the present invention will be better understood with reference to the accompanying figures and detailed description.

BRIEF DESCRIPTION OF THE DRAWINGS

Reference will now be made to the accompanying figures from which the novel features and advantages of the present invention will be apparent:

FIG. 8 is a cross-sectional view taken along line 8—8 in FIG. 7 showing interconnection of a horizontal track with a horizontal rail;

FIG. 9 is a cross-sectional view taken along line 9—9 in FIG. 7 showing interconnection of a horizontal track with a horizontal rail;

FIG. 10A is an enlarged partial cross-sectional view of a horizontal rail configuration in accordance with one embodiment of the present invention; and FIG. 10B is a view similar to FIG. 10A showing a horizontal rail configuration in accordance with a second use of the present invention.

DETAILED DESCRIPTION OF THE INVENTION

Figure 1:
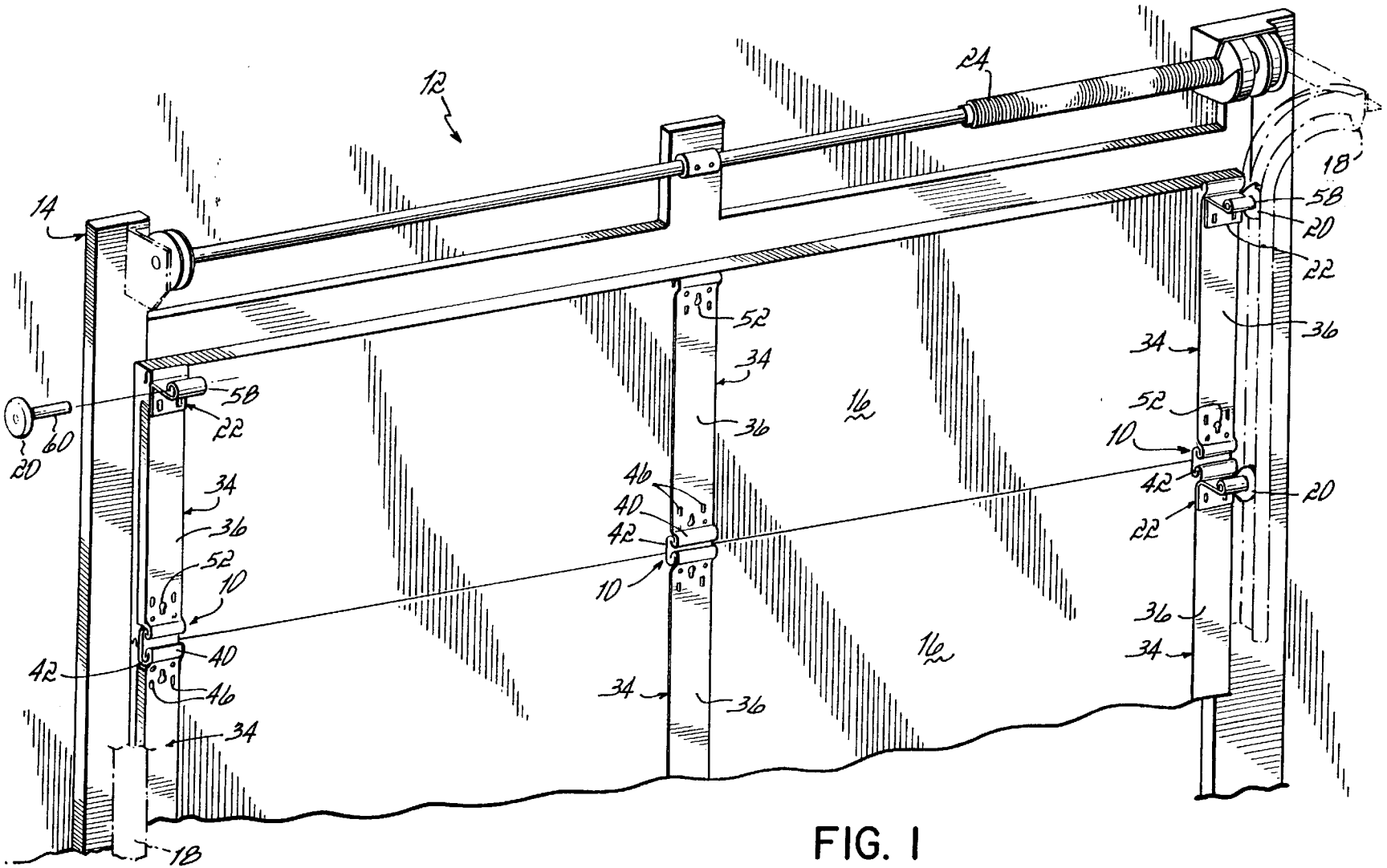
FIG. 1 is a perspective view, partially broken away, of a connection system in accordance with the present invention for interconnecting components of an overhead garage door system.

With reference to the figures, and to FIG. 1 in particular, a connection system 10 in accordance with the principles of the present invention is shown for interconnecting components of an overhead garage door system 12. The overhead garage door system 12 includes a conventional door frame 14 which defines an opening into a garage, and a series of interconnected door panels 16 which articulate in a known manner between a vertical position as shown in FIG. 1 and an overhead, horizontal position not shown. The movement of the garage door panels 16 between the vertical and horizontal positions is defined by a pair of door tracks 18 (shown in phantom) which are located on either side of the door frame 14. The door tracks 18 cooperate with a series of rollers 20 supported along opposite sides of the door panels by roller brackets 22 as will be described in more detail below. A torsion spring 24 is mounted along a top edge of the door frame 14 to counterbalance the weight of the door panels 16 and thus ease movement of the interconnected door panels between the vertical and horizontal positions as is well known in the art.

Figure 2:
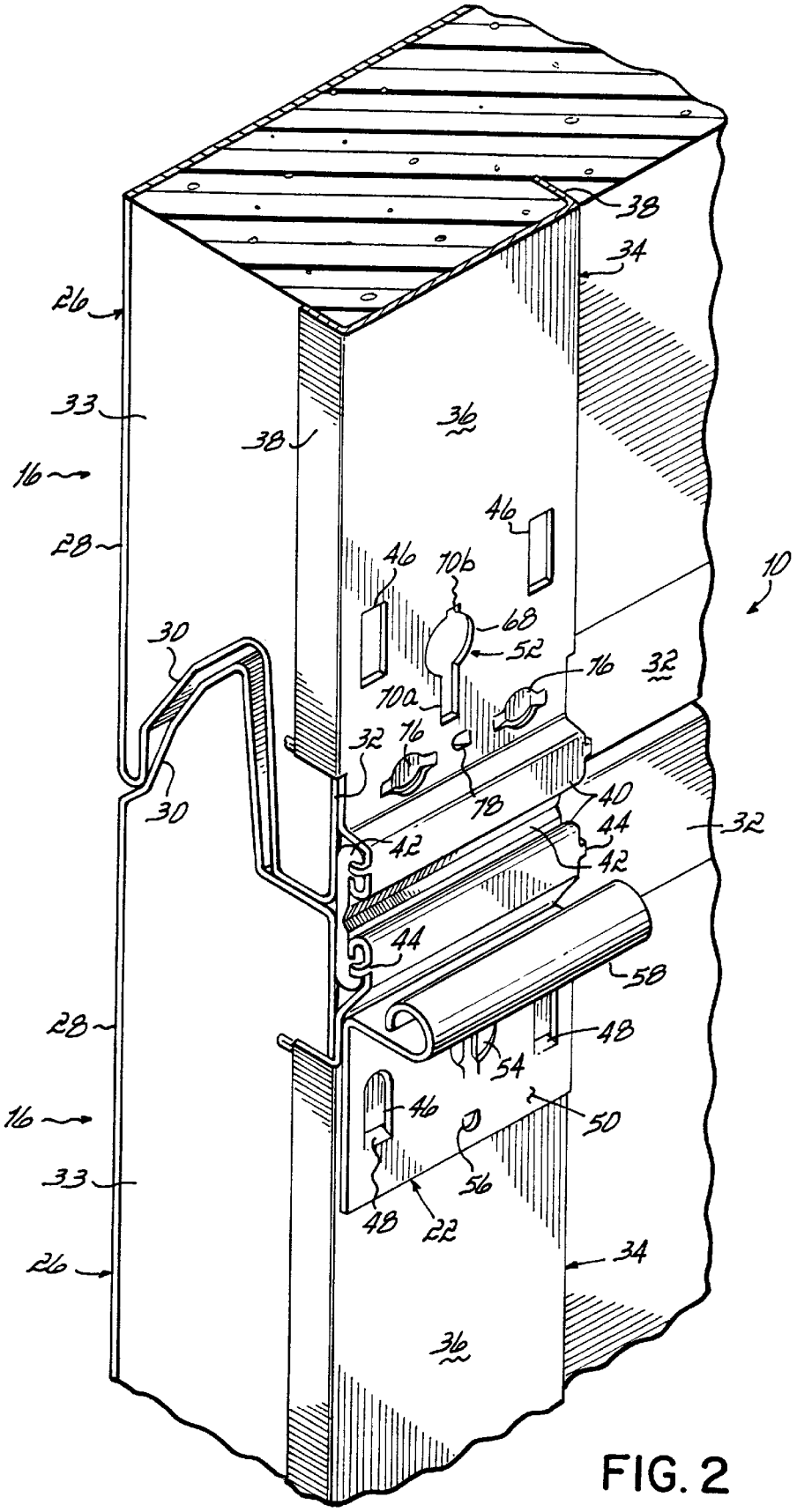
FIG. 2 is a partial perspective view of one use of the present invention for interconnecting roller brackets and door stiles with an overhead garage door panel.
Figures 3, 3A:
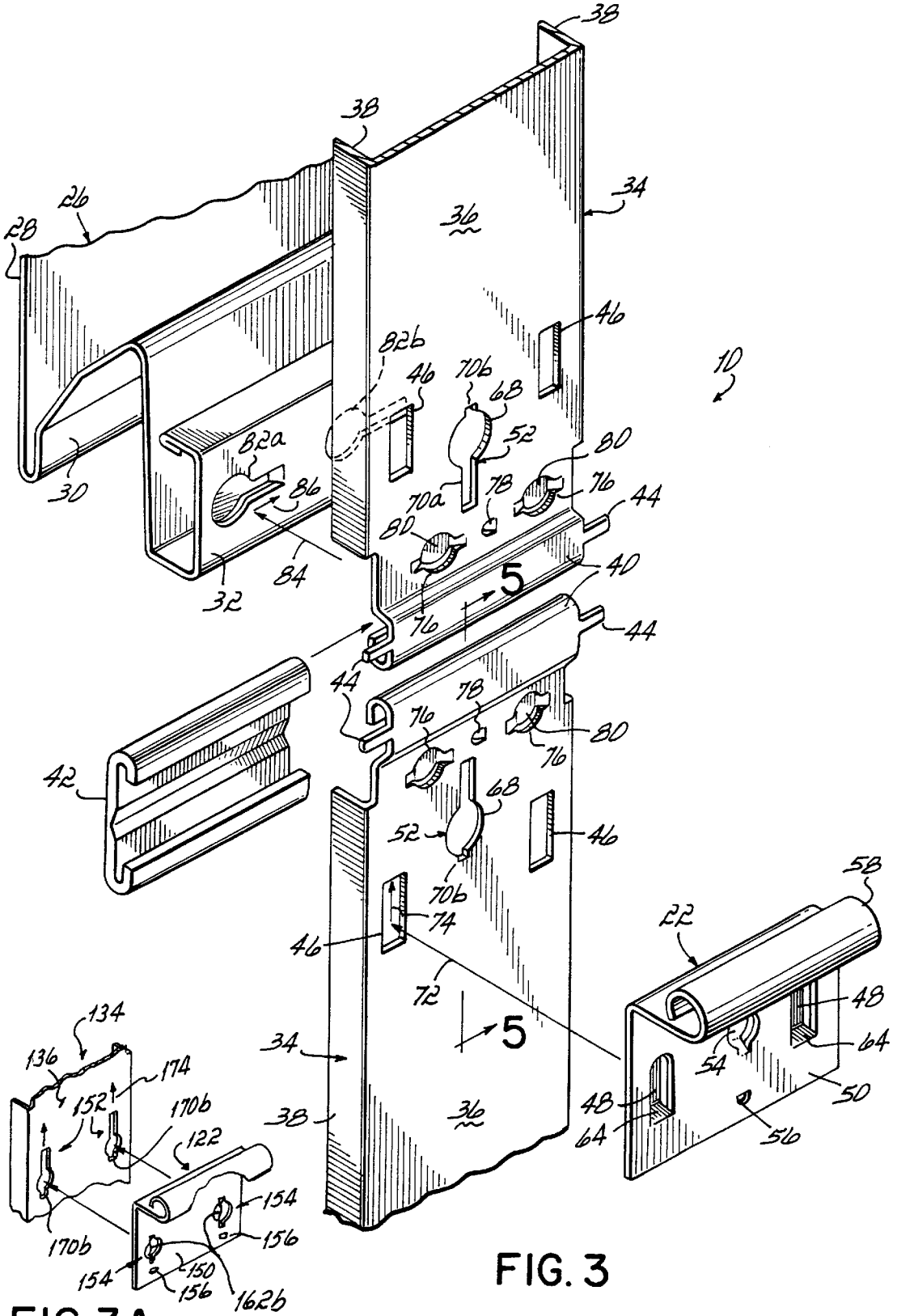
FIG. 3 is an exploded perspective view showing components of the connection system shown in FIG. 2.
FIG. 3A is a partial perspective view, similar to FIG. 3, showing an alternative embodiment of the present invention.
Figure 4:
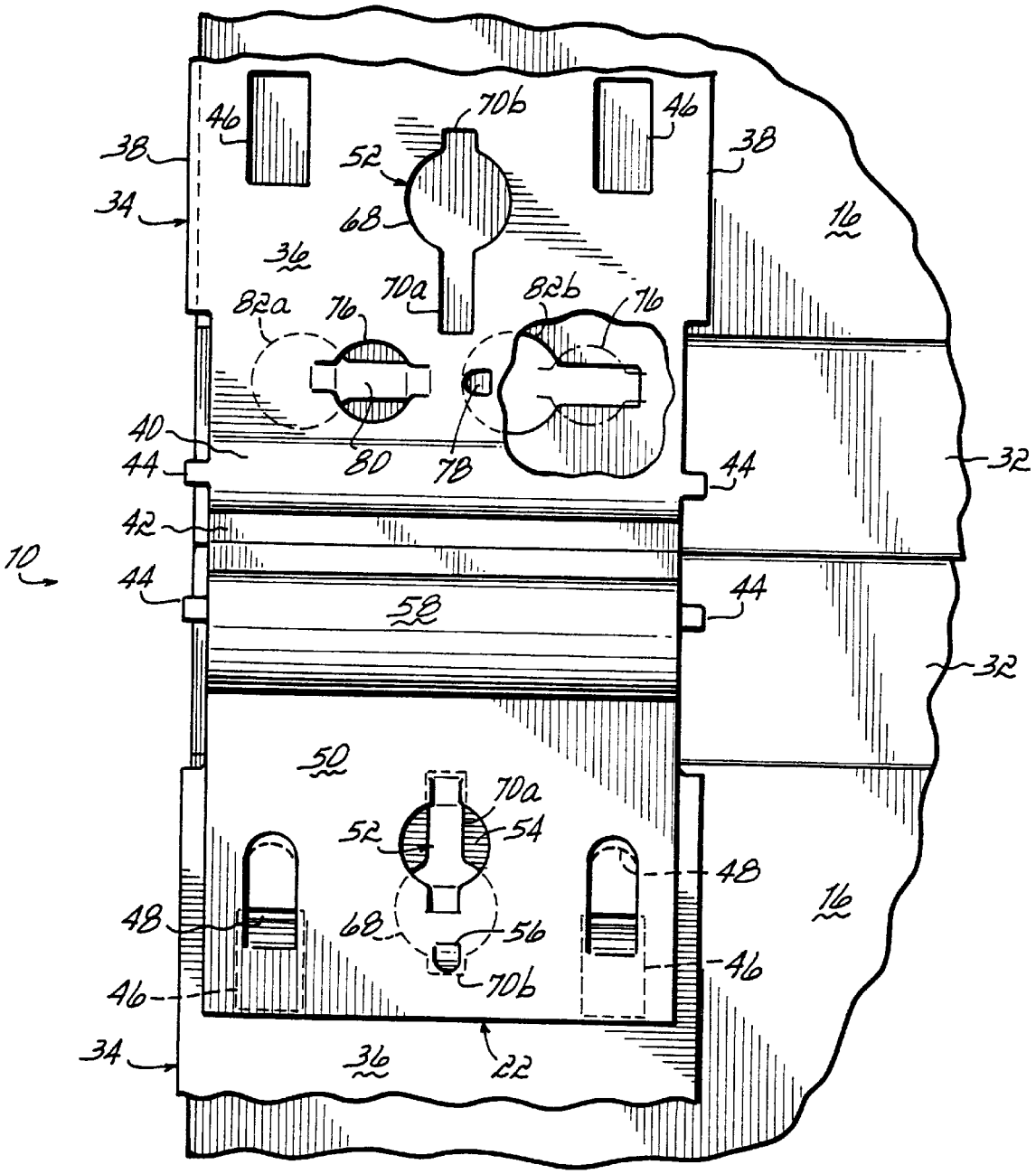
FIG. 4 is a front view showing the connection system of FIG. 2.

As shown most clearly in FIGS. 2–3, each of the door panels 16 preferably comprises a formed metallic door skin 26 which includes an outer face 28, a pinch-resistant joint 30, and an inner rib 32 which extend along the longitudinal length of the door panel. The outer face 28, joint 30 and inner rib 32 of the door panel 16 define a cavity which is preferably filled with a suitable foam composition 33 as is described in detail by way of example in U.S. Pat. No. 5,435,108, assigned to the assignee of the present invention, and which is incorporated herein by reference in its entirety. While a pinch-resistant, foam-filled pan door panel 16 is shown and described, the present invention is readily adaptable to other configurations of door panels without departing from the spirit and scope of the present invention.

With further reference to FIG. 1, each of the door panels 16 includes a series of vertically aligned and spaced door stiles 34 which extend between longitudinal edges of each door panel. As will be described in more detail below, the door stiles 34 are pivotally interconnected between adjacent door panels 1 6 to provide pivotal movement of the door panels between the vertical and horizontal positions. The door stiles 34 are preferably formed of metal and include a generally planar web 36 and a pair of spaced transverse legs 38 which extend partially along opposite sides of the stiles. At each end of the door stiles 34, a hinge mount 40 is provided to slidably receive and support a portion of a living hinge 42 within the hinge mount. In this way, as shown most clearly in FIG. 2, the living hinges 42 are located at the joints between adjacent door panels 16 and are supported by pairs of hinge mounts 40 at adjacent ends of the door stiles 34. By way of example, details of the construction and operation of living hinges may be found in U.S. Pat. Nos. 4,995,441, 5,054,536 and 5,129,44, all assigned to the assignee of the present invention, which are incorporated herein by reference in their entirety. As shown in FIGS. 2 and 3, tabs 44 are preferably formed on opposite sides of the hinge mounts 40, and are adapted to fold over and capture the living hinges 42 within the hinge mounts 40.

Now referring to FIGS. 2–6, roller brackets 22 are shown interconnected to the door stiles 34 through the connection system 10 of the present invention for supporting the rollers 20. In particular, each end of the door stiles 34 includes a pair of spaced apart apertures 46 formed in the planar web 36 of the stiles which are shaped and aligned to receive a pair of hooks 48 which extend from a substantially planar body 50 of the roller bracket 22. Each end of the door stiles 34 further includes an aperture 52 formed in the planar web 36 of the stiles which is shaped and aligned to receive a guide member 54 which extends from the planar body 50 of the roller bracket 22. The roller bracket 22 further includes a detent 56 which is preferably formed from material punched from the roller bracket and which extends in the same direction as the hooks 48 and the guide member 54 for purposes to be described in more detail below. The roller brackets 22 each include a tubular end 58 which is adapted to support a shaft 60 of the rollers 22 in a conventional manner.

Figure 6:
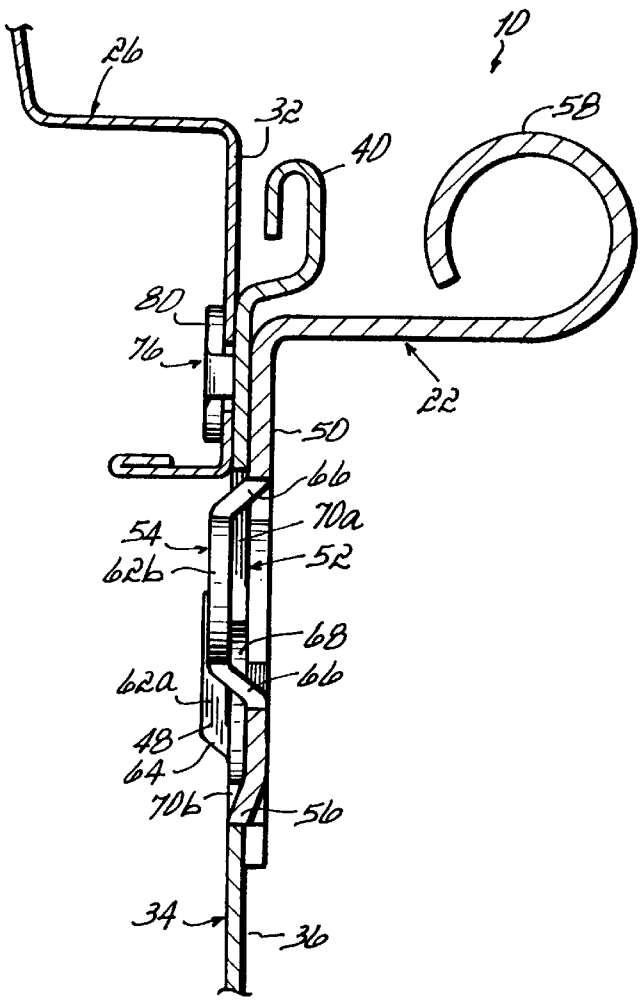
FIG. 6 is a view similar to FIG. 5 showing components of the connection system after assembly in accordance with one embodiment of the invention.
Figure 5:
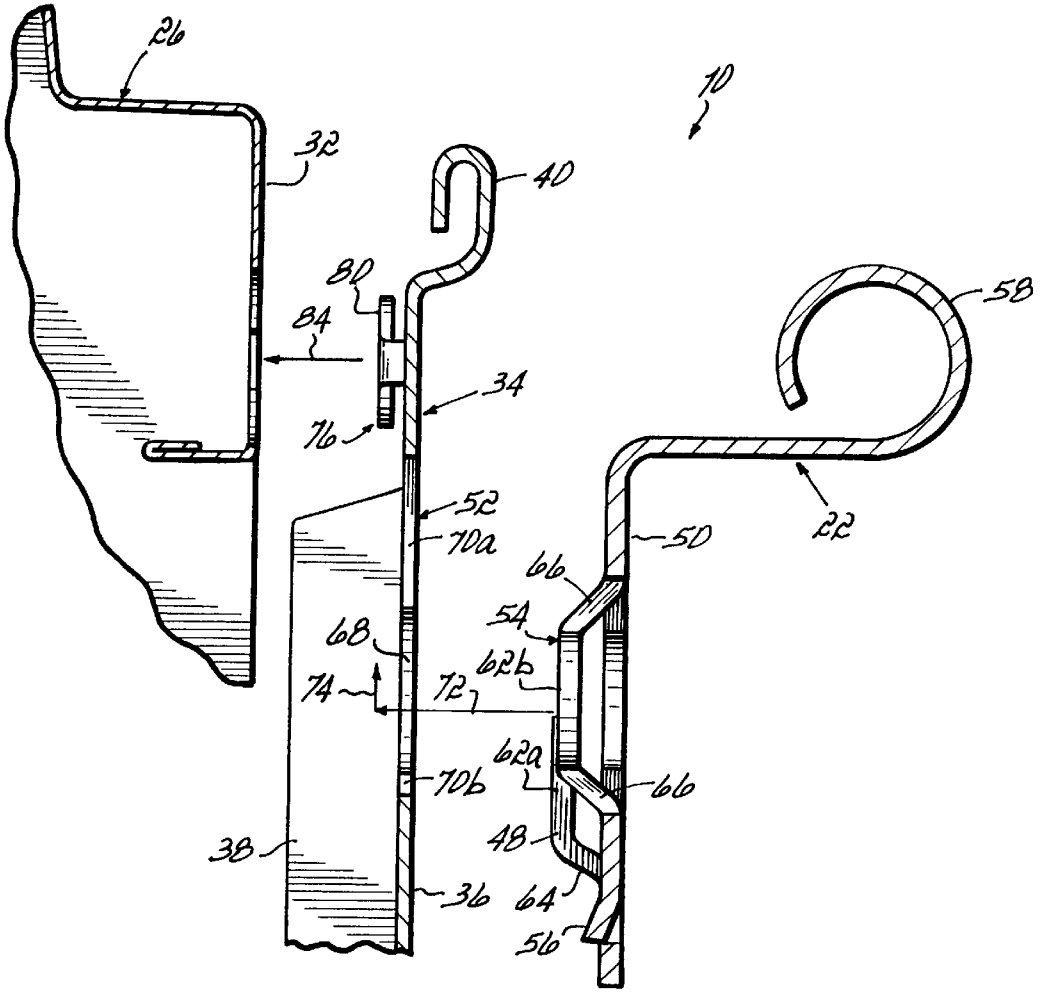
FIG. 5 is an exploded cross-sectional view, taken along line 5—5 of FIG. 3, showing components of the connection system before assembly.

Preferably, as shown most clearly in FIGS. 5 and 6, the hooks 48 and the guide member 54 include respective retaining elements 62*a* and 62*b* which are offset from and substantially parallel to the planar body 50 of the roller bracket. Offset retaining elements 62*a* of hooks 48 are preferably joined to the roller brackets 22 through integral legs 64. Offset retaining elements 62*b* of guide members 54, which are preferably circular in configuration, are joined to the roller brackets 22 through pairs of diametrically opposite webs 66. Preferably, retaining elements 62*a* and 62*b* of hooks 48 and guide members 54, respectively, comprise material punched from the planar body 50 of the roller brackets 22.

The aperture 52 of door stiles 34 is located between the spaced apart apertures 46, and is preferably at least partially aligned with the spaced apart apertures 46 between opposite longitudinal edges of the door stile 34. The guide member 54 of the roller bracket 22 is also preferably at least partially aligned with the pair of hooks 48 between the opposite longitudinal edges of the door stile 34. In one embodiment shown, the guide member 54 and detent 56 are aligned with a longitudinal axis of the roller bracket 22. Aperture 52 preferably includes an opening 68 (see FIG. 3) sized slightly larger than retaining element 62*b* of guide member 54, and a pair of diametrically opposite slots 70*a* and 70*b* (see FIG. 3) which extend from the opening 68 and are sized slightly smaller than retaining element 62*b* but slightly larger than webs 66. The slots 70*a* and 70*b* are preferably aligned with the longitudinal axis of the roller bracket 22, and slot 70*b* is preferably shorter in length than slot 70*a* for purposes to be described in detail below.

With further reference to FIGS. 3–6, the roller bracket 22 is connected to the door stile 34 by first aligning the hooks 48 with the spaced apart apertures 46, and also by aligning the guide member 54 with the opening 60, as represented by arrow 72 in FIGS. 3 and 5. With the roller bracket 22 and door stile 34 aligned in face-abutting relationship (see FIG. 6), the components are then translated relative to each other in the direction of arrow 74 shown in FIGS. 3 and 5 until the detent 56 engages the slot 70*b* of aperture 52 as shown in FIG. 6. In this way, as shown most clearly in FIGS. 2 and 4, the hooks 48 and guide member 54 of each roller bracket 22 engage and capture part of the door stile 34 between the respective offset retaining elements 62*a* and 62*b* and the planar body 50 of the roller bracket. The engagement of the detent 56 with the slot 70*b* prevents unintentional disengagement of the roller bracket 22 from the door stile 34. Separation of the roller bracket 22 from the door stile 34 is affected by disengaging the detent 56 from the slot 70*b* and then translating the components in a direction opposite to that represented by arrow 74 in FIGS. 3 and 5.

In an alternative embodiment shown in FIG. 3A, a modified roller bracket 122 includes a pair of spaced guide members 154 and a pair of detents 156 which extend in the same direction from a substantially planar body 150 of the roller bracket 122. The guide members 154 and detents 156 each preferably have the same respective structure as the guide member 54 and detent 56 as described in detail above. A modified door stile 134 includes a pair of apertures 152 formed in a planar web 136 of the stile which are shaped and aligned to receive the guide members 154. Preferably, the apertures 152 have the same structure as the apertures 52 described in detail above. With the roller bracket 122 and door stile 134 aligned in face-abutting relationship, the components are translated relative to each other in the direction of arrow 174 until the detents 156 engage slots 170*b* of apertures 152. In this way, the guide members 154 of each roller bracket 122 engage and capture part of the door stile 134 between the respective offset retaining elements 162*b* and the planar body 150 of the roller bracket 122. The engagement of the detents 156 with the slots 170*b* prevents unintentional disengagement of the roller bracket 122 from the door stile 134. Separation of the roller bracket 122 from the door stile 134 is affected by disengaging the detents 156 from the slots 170*b* and then translating the components in a direction opposite to that represented by arrow 174.

In another aspect of the present invention, as shown most clearly in FIGS. 2–6, each of the door stiles 34 has a pair of guide members 76 and an intermediate detent 78 which extend from the planar web 36 of the door stile. Each of the guide members 76 includes a retaining element 80, preferably circular in shape, which is offset from and substantially parallel to the planar web 36 of the door stile 24. The inner rib 32 of the door panels 16 includes a pair of spaded apart apertures 82*a* and 82*b* which are shaped and aligned to receive the guide members 76 upon registration of the door stiles 34 and door panels 16 in face-abutting relationship as represented by arrow 84 in FIGS. 3 and 5. As the door stile 34 is translated relative to the door panel 16 in a direction represented by arrow 86 in FIG. 3, the detent 78 engages aperture 82*b* in the inner rib 32 of door panel 16. In this way, as shown most clearly in FIGS. 2 and 4, the guide members 76 of each door stile 34 engage and capture part of the inner rib 32 of the door panel 16 between the offset retaining element 80 and the planar web 36 of the door stile 34 (see FIG. 4). The engagement of the detent 78 with the aperture 82*b* prevents unintentional disengagement of the door stile 34 from the door panel 16. Separation of the door stile 34 from the door panel 16 is likewise affected by disengaging the detent 78 from the aperture 82*b* and then translating the components in a direction opposite to that represented by arrow 86 in FIG. 3.

Figure 7:
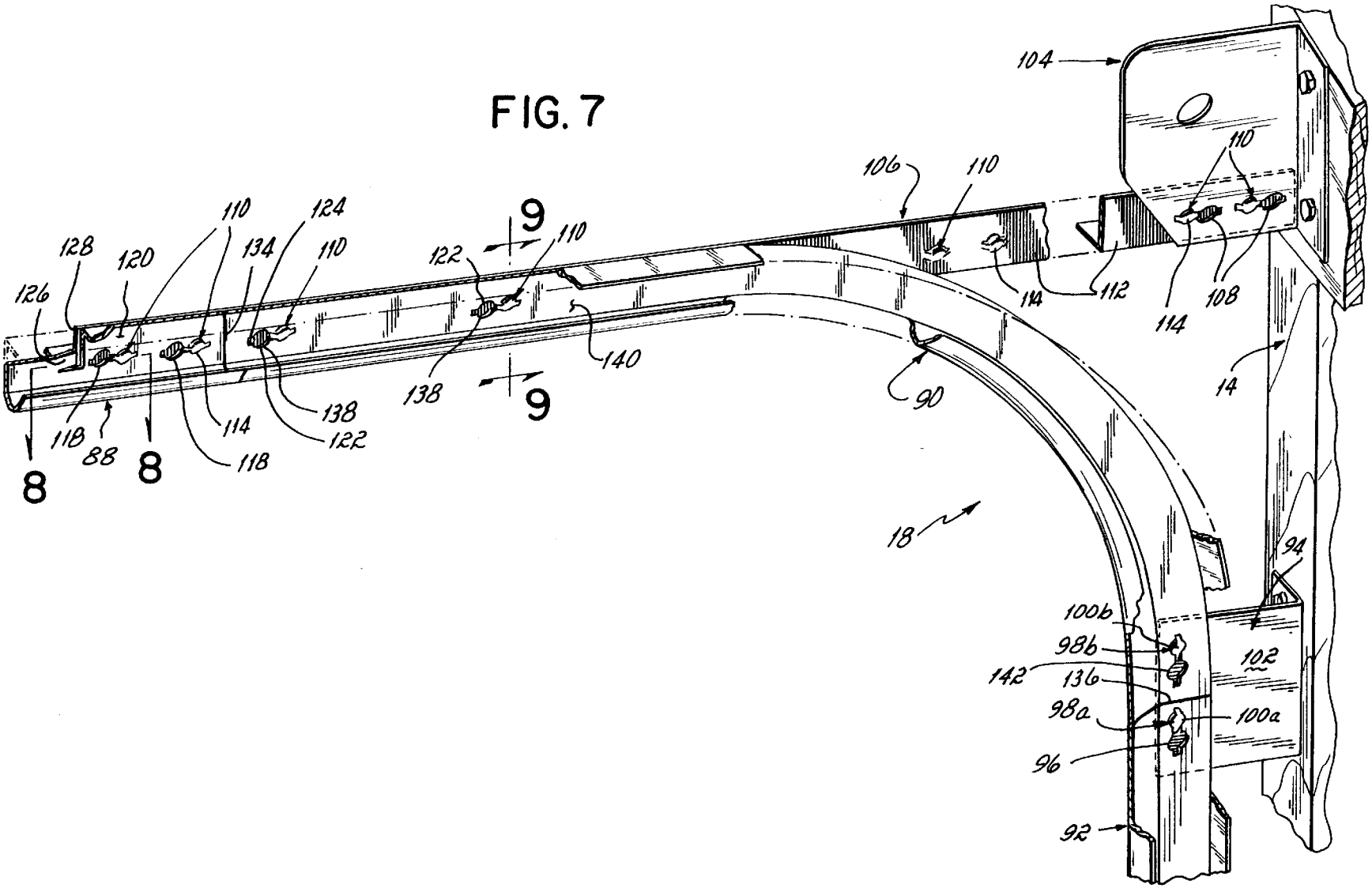
FIG. 7 is a partial perspective view showing a second use of the present invention for interconnecting components of an overhead garage door track.

Now referring to FIGS. 7–10B, interconnection of the door tracks 18 in accordance with another aspect of the present invention is shown in greater detail. While only one door track 18 is shown in FIG. 7, it will be appreciated that the other door track located on the opposite side of door panels 16 is preferably identical in construction and operation and the same description applies equally as well to both. In accordance with the present invention, each door track 18 preferably includes a horizontal track 88, a track radius 90 and a vertical track 92 which are supported by the door frame 14 to guide vertical and horizontal movement of the overhead garage door.

As shown in FIG. 7, the vertical track 92 is mounted generally parallel to the door frame 14 through a series of jamb brackets 94 (one shown) which are mounted to the door frame through suitable fasteners. Each vertical track 92 preferably includes an aperture 96 on an upper end thereof which is shaped and sized to receive a guide member 98*a* which extends from the jamb bracket 94. The guide member 98*a* preferably includes a retaining element 100*a* which is offset from and substantially parallel to a vertical surface 102 of the jamb bracket 94. As the jamb bracket 94 and vertical track 92 are translated relative to each other, the retaining element 100*a* engages and captures part of the vertical track between the retaining element and the vertical surface of the jamb bracket. While not shown, it will be appreciated that a similar jamb bracket is connected at a lower end of the vertical track 92 to further mount the vertical track to the door frame 14.

A torsion tube end bearing plate 104 is mounted on opposite sides of the door frame 14 for supporting the torsion spring 24 (FIG. 1). Each bearing plate 104 supports an angled rail 106 which extends generally horizontally from the door frame 14. Preferably, each bearing plate 104 includes a pair of apertures 108 which are shaped and sized to receive a pair of guide members 110 which extend from a vertical surface 112 of the horizontal rail 106. The guide members 110 preferably include retaining elements 114 which are offset from and substantially parallel to the vertical surface 112 of the horizontal rail 106. As shown most clearly in FIGS. 7 and 8, the offset retaining elements 114 of horizontal rail 106 are preferably circular in cross-section and are joined to the horizontal rail through pairs of diametrically opposite webs 116. As the horizontal rail 106 and bearing plate 104 are translated relative to each other, the retaining elements 114 engage and capture part of the bearing plate 104 between the retaining elements and the vertical surface of the horizontal rail 106. While not shown, it will be appreciated that in another embodiment, bearing plates 104 and horizontal rails 106 could be an integral, unitary piece.

The horizontal tracks 88 are mounted at a remote end of the horizontal rail 106 and extend rearwardly from the door frame 14. While not shown, it will be understood by those skilled in the art that the rearward most ends of the horizontal tracks 88 are supported through suitable means by a supporting structure of the garage ceiling. Depending on the size of the garage door, it will be appreciated that the horizontal rails 106 may be 32", 94" or 106" in length, while the horizontal tracks 88 may be between 72" and 84" in length, for example.

Referring to FIGS. 7–8, the horizontal tracks 88 preferably include a series of apertures 118 formed in a vertical surface 120 of the horizontal tracks which are shaped and aligned to receive the guide members 110 which extend from the horizontal rails 106. Preferably, each of the apertures 118 includes an opening 122 (FIG. 8) sized slightly larger than the retaining element 114 of guide member 110, and a pair of diametrically opposite slots 124 (FIG. 8) which extend from the opening 122 and are sized slightly smaller than the retaining element 114 but slightly larger than webs 116.

Further referring to FIGS. 7–8, with the horizontal rails 106 and horizontal tracks 88 aligned in face-abutting relationship, the components are then translated relative to each other until a deflectable tab 126 on each horizontal track 88 engages a respective end 128 of the horizontal rails 106. In this way, the guide members 110 of each horizontal rail 106 engage and capture part of the horizontal track 88 between the respective offset retaining elements 114 and the vertical surface 112 of the horizontal rail 106. The engagement of the deflectable tab 126 with the end 128 of the horizontal rail 106 prevents unintentional disengagement of the horizontal rail from the bearing plate 104 mounted to the door frame 14. Separation of the horizontal rail 106 from the horizontal track 88 is affected by disengaging the deflectable tab 126 from the end 128 of horizontal rail 106 and then translating the components in an opposite direction.

With further reference to FIG. 7, the track radius 90 is mounted intermediate the horizontal track 88 and the vertical track 92. More particularly, each track radius 90 is mounted to the horizontal rail 106 and the jamb bracket 94 such that the track radius substantially abuts an end 134 of the horizontal track 88 and an end 136 of the vertical track 92. Preferably, each track radius 90 has a defined radius which varies between 10", 12" and 15", although other radiuses are also contemplated. While not shown, it will be appreciated that in another embodiment, track radius 90 could be an integral extension of the horizontal track 88.

At one end near the horizontal rails 106, each track radius 90 preferably includes a series of apertures 138 formed in a vertical surface 140 of the track radius which are shaped and aligned to receive the guide members 110 which extend from the horizontal rails 106. As the horizontal rails 106 and track radiuses 90 are translated relative to each other, the retaining elements 114 of guide members 110 engage and capture part of the track radius between the retaining element 114 and the vertical surface 112 of the horizontal rail.

Now referring to FIGS. 10A and 10B, a preferred cross-sectional profile of the track radius 90 is shown for accommodating changes in material thickness of the track radiuses while maintaining proper engagement of the guide members 110 of the horizontal rails 106 with the apertures 138 of the track radiuses 90. In order to prevent having to change the depth of the guide members 110 as the material thickness in the track radiuses 90 changes, the vertical surface 140 of the track radiuses 90 is offset relative to a rearward contact surface 130 of the track radiuses to maintain a substantially constant offset 141 (FIGS. 10A and 10B) for any material thickness of the track radiuses 90. Thus, while the thickness of material in the track radiuses 90 of FIG. 10A may be 0.083", for example, the offset 141 is substantially the same for the track radius 90 in FIG. 10B which may have a material thickness of 0.040", for example, to substantially match the depth of the guide member 110 of the horizontal rail 106. The offset 141 is preferably roll-formed in the vertical surface 140 of the track radius 90, although a continuous or intermittent stamping of the offset is also contemplated. It will be appreciated that the constant offset 141 in the track radiuses 90 thereby allows a standard horizontal rail 106 to be used with all track radiuses of varying material thickness. Moreover, as shown most clearly in FIGS. 9 and 10A–10B, an offset "X" formed in the track radiuses 90 prevents the guide members 110 of the horizontal rails 106 from interfering with the rollers 20 attached to the door panels 16. It will be understood that the horizontal tracks 88 and vertical tracks 92 preferably have the same cross-sectional profile as the track radiuses 90 to achieve the same benefits as described in detail above.

Each track radius 90 further preferably includes an aperture 142 at the other end near the vertical track 92 which is shaped and sized to receive a guide member 98*b* which extends from the jamb bracket 94. Each aperture 138 and 142 in track radiuses 90 preferably has the same configuration as apertures 118 in the horizontal tracks 88. The guide member 98*b* preferably includes a retaining element 100*b* which is offset from and substantially parallel to the vertical surface 102 of the jamb bracket 94. As the jamb bracket 94 and track radius 90 are translated relative to each other, the retaining element 100*b* engages and captures part of the track radius between the retaining element 100*b* and the vertical surface of the jamb bracket.

In accordance with the present invention, each track radius 90 is preferably interchangeable with a different track radius having a different defined radius. Thus, the need for a dealer or installer to inventory separate horizontal track members having different track radiuses is completely eliminated. Rather, the horizontal rails 106, horizontal tracks 88 and vertical tracks 92 become standard overhead garage door components which may be then connected at the site with the proper 10", 12" or 15" track radius 90 as may be required. Moreover, the interconnection of the door tracks 18 in accordance with the present invention thus eliminates the need for additional fasteners to be installed in the field or for hardware to be riveted or bolted to track components at the factory before shipment.

Those skilled in the art will readily appreciate that the present invention provides a rapid, yet reliable, interconnection of two or more components for numerous applications. The connection system of the present invention is relatively easy to manufacture and provides interconnection of components without the need for additional fasteners or the manufacture of complicated mechanical structures on the components to establish the interconnection. While the present invention is shown and described in detail in relation to interconnection of components of an overhead garage door system, those skilled in the art will readily appreciate applicability of the present invention to numerous applications requiring the interconnection of two or more components. Thus, it is not Applicants' intent to limit the scope of the present invention in any way to overhead garage door systems, although such an application is contemplated in one embodiment of the present invention. The invention in its broader aspects is therefore not limited to overhead garage door systems, but is rather adaptable to a broader spectrum of applications for the interconnection of two or more components.

From the above disclosure of the general principles of the present invention and the preceding detailed description of preferred embodiments, those skilled in the will readily comprehend the various modifications to which the present invention is susceptible. For example, it is contemplated that the hooks 48 and guide member 54 of the roller bracket 22 may be reversed with the spaced apart apertures 46 and aperture 52 of the door stile 34 by merely interchanging the parts. Likewise, it is also contemplated that the guide members 76 of the door stiles 34 may be reversed with the apertures 82*a* and 82*b* in the inner rib 32 of the door panels 16. Additionally, the guide members 110 of the horizontal rails 106 and the apertures in the door tracks 18 may likewise be reversed without departing from the spirit and scope of the present invention. Changes in the configuration of the various cooperating apertures and guide members is also contemplated. Moreover, other configurations of door panels and interconnection of other components of an overhead garage door system are also contemplated. The invention in its broader aspects is therefore not limited to the specific details and illustrative example shown and described. Accordingly, departures may be made from such details without departing from the spirit or scope of Applicants' general inventive concept. Therefore, Applicants desire to be limited only by the scope of the following claims and equivalents thereof:

Having described the invention, we claim:

1. A connection system for use in assembly of an overhead garage door, comprising;

a roller bracket having a roller support mechanism extending from a plane thereof and a roller supported by said roller support mechanism, a guide member, and a pair of hook members spaced laterally from said guide member on opposite sides thereof, each of said guide member and said spaced apart hook members extending from the plane of said roller bracket in a first direction, said roller bracket further having a detent member formed of material upset from the roller bracket extending from the plane thereof in said first direction; and a door stile having a pair of spaced apart first apertures shaped and aligned to receive said hook members, and a second intermediate aperture shaped and aligned to receive said guide member upon registration of said roller bracket and door stile in face-abutting relationship, said detent member engaging said second aperture upon translation of said roller bracket and door stile relative to each other to thereby establish a connection between said roller bracket and said door stile.

2. A connection system for use in assembly of an overhead garage door, comprising:

a plurality of cooperating door panels operable to move between vertical and horizontal positions along a pair of door tracks;

a plurality of roller brackets associated with said door panels for supporting a plurality of rollers which are rotatable in said door tracks, each of said roller brackets having a roller support mechanism extending from a plane thereof, a guide member, and a pair of hook members spaced laterally from said guide member on opposite sides thereof, each of said guide member and said spaced apart hook members extending from the plane of said roller bracket in a first direction, each of said roller brackets further having a detent member formed of material upset from the roller bracket extending from the plane thereof in said first direction; and a plurality of door stiles mounted on said plurality of door panels, each of said door stiles having a pair of spaced apart first apertures shaped and aligned to receive said hook members, and a second intermediate aperture shaped and aligned to receive said guide member upon registration of said roller brackets and door stiles in face-abutting relationship, said detent member engaging said second aperture upon translation of said roller bracket and door stile relative to each other to thereby establish a connection between said roller brackets and said door stiles.

3. The connection system of claim 2 wherein each of said door panels includes at least two door stiles aligned vertically between longitudinal edges of said door panel, said door stiles of one door panel being pivotally connected at each end with door stiles of an adjacent door panel for permitting pivotal movement of said door panels between said vertical and horizontal positions.

4. The connection system of claim 3 further including a flexible hinge mounted between adjacent ends of said door stiles to provide said pivotal connection between said adjacent door panels.

5. The connection system of claim 2 wherein each of said door stiles includes a pair of spaced apart guide members and an intermediate detent member extending from a plane thereof, each of said door panels having a pair of spaced apart apertures shaped and aligned to receive said guide members upon registration of said door stiles and door panels in face-abutting relationship, said detent member engaging one of said spaced apart apertures upon translation of said door stiles and door panels relative to each other to thereby establish a connection between said door stiles and said door panels.

6. The connection system of claim 5 wherein each of said guide members of said door stiles includes a retaining element which is offset from and substantially parallel to a plane thereof.

7. The connection system of claim 6 wherein each of said spaced apart apertures comprises an opening sized slightly larger than said retaining element and a slot which extends from said opening and sized slightly smaller than said retaining element.

* * * * *